US009508513B1

(12) United States Patent
Shen

(10) Patent No.: US 9,508,513 B1
(45) Date of Patent: Nov. 29, 2016

(54) COAXIAL RF SWITCH OPTOELECTRONIC INDICATORS AND METHOD OF MAKING SAME

(71) Applicant: Jun Shen, Phoenix, AZ (US)

(72) Inventor: Jun Shen, Phoenix, AZ (US)

(73) Assignee: Magvention (Suzhou), Ltd., Suzhou (CN)

( * ) Notice: Subject to any disclaimer, the term of this patent is extended or adjusted under 35 U.S.C. 154(b) by 0 days.

(21) Appl. No.: 14/883,537

(22) Filed: Oct. 14, 2015

(30) Foreign Application Priority Data

Sep. 29, 2015 (CN) ..... 2015 1 0629019

(51) Int. Cl.
*H01H 50/08* (2006.01)
*H01H 50/24* (2006.01)

(52) U.S. Cl.
CPC ..... *H01H 50/08* (2013.01); *H01H 50/24* (2013.01); *H01H 2219/014* (2013.01); *H01H 2219/054* (2013.01)

(58) Field of Classification Search
CPC ..... H01H 50/08; H01H 50/24; H01H 2219/014; H01H 2219/054
See application file for complete search history.

(56) References Cited

U.S. PATENT DOCUMENTS

2010/0052830 A1* 3/2010 Shinoura ..... H01H 43/022 335/202

* cited by examiner

*Primary Examiner* — Mohamad Musleh

(57) ABSTRACT

A coaxial RF switch optoelectronic indicator comprising a light-emitting diode (LED), a photo sensor, and a shutter assembly wherein the shutter assembly interacts with the soft-iron rocker in the switch and causes the optical path between the LED and photo-sensor to open or close, corresponding to the states (connected or disconnected) of an RF channel in the switch, providing an indicator means to the switch.

11 Claims, 3 Drawing Sheets

COAXIAL RF SWITCH OPTOELECTRONIC INDICATORS AND METHOD OF MAKING SAME

FIELD OF THE INVENTION

The present invention relates to optoelectronic indicators used in switches and relays. More specifically, the present invention relates to optoelectronic indicators used in coaxial RF switches and to methods of making the same.

BACKGROUND OF THE INVENTION

Coaxial RF switches are special types of electromechanical relays (or switches) wherein radio frequency (RF) signals are connected or disconnected between terminals in the switch. Typically a coaxial RF switch utilizes a pusher to push a conductor reed to make contact with a pair of coaxial conductor heads and connect the signal path between the two coaxial conductors. A common design uses a soft magnetic rocker under a pair of electromagnets to push the pusher for the switching action. Coaxial RF switches often employ indicator structures to provide indication (closed or open) of the state of the RF channels. A common indicator structure typically includes a pair of auxiliary moving and stationary contacts, and a pusher. The moving contact is typically formed on a cantilever. The pusher interacts with the actuation mechanism (e.g., the rocker) in the coaxial RF switch and pushes the cantilever and causes the moving contact to disconnect or connect with the stationary contact to provide the indication function. However, the reliable auxiliary contact requires suitable contact pressure, which increases the complexity in tuning and adjusting the actuation mechanism of the switch. Additionally, the auxiliary contact structure needs to interact with the switch actuation mechanisms, and thus it is difficult to form a sealed enclosure to protect the auxiliary contacts, resulting in contact failures because of contamination. This renders the auxiliary contact indicator unreliable.

It is highly desirable to provide an indicator means which is easy to manufacture and highly reliable.

It is a purpose of the present invention to provide a new and improved indicator which is simple to manufacture and highly reliable.

SUMMARY OF THE INVENTION

The above problems and others are at least partially solved and the above purposes and others are realized in a coaxial RF switch optoelectronic indicator comprising a light-emitting diode (LED), a photo sensor, and a shutter assembly wherein the shutter assembly interacts with the soft-iron rocker in the switch and causes the optical path between the LED and photo-sensor to open or close, corresponding to the states (connected or disconnected) of an RF channel in the switch, providing an indicator means to the switch.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and.

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay or switches for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical failsafe switches may be spatially arranged in any orientation or manner. Multi-pole-multi-throw types of these switches can also be formed by arranging them in appropriate ways and with appropriate devices.

Figure 1:
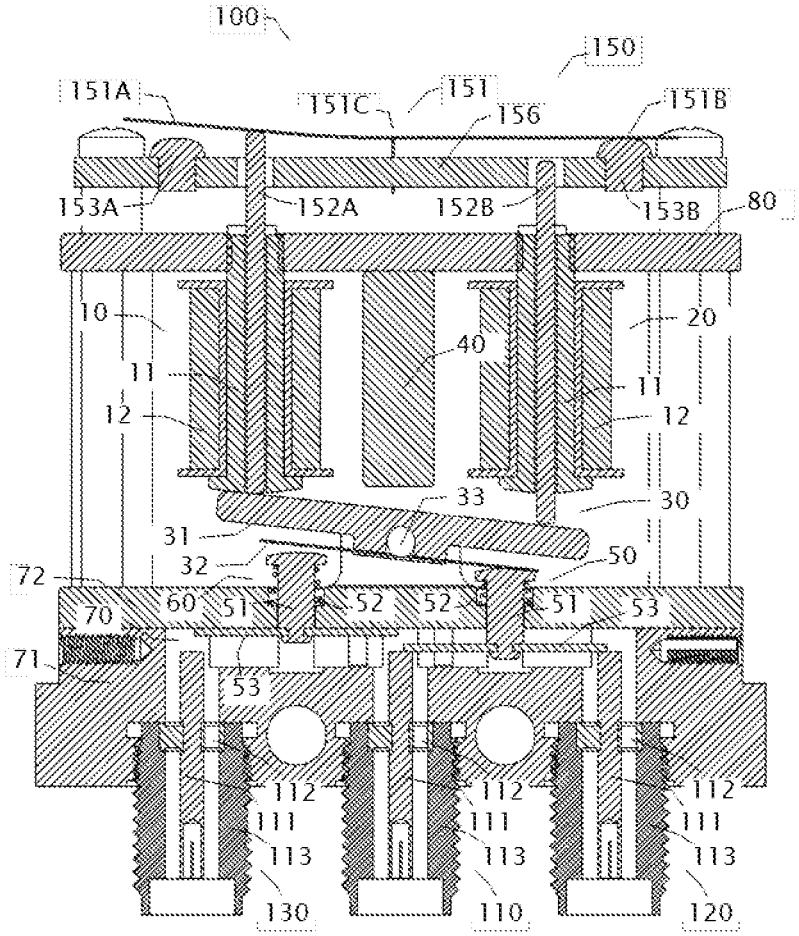
FIG. 1 is a cross-sectional view of a prior art coaxial RF switch indicator with auxiliary contacts.

FIG. 1 shows a cross-sectional view of a prior art coaxial RF switch indicator with auxiliary contacts. With reference to FIG. 1, a prior art coaxial RF switch 100 suitably comprises a pair of solenoids 10 and 20, rocker assembly 30, permanent magnet 40, soft magnetic plate 80, pusher assemblies 50 and 60, cavity 70, coaxial connectors 110, 120, and 130, and indicator assembly 150.

Solenoids 10 and 20 are formed by having coils 12 wound around a bobbin and a soft magnetic core 11. Rocker assembly 30 comprises soft magnetic rocker 31, rocker cantilever 32 and pivot 33. Pusher assemblies 50 and 60 comprises pusher 51, restoring spring 52 and conductor reed 53. Cavity 70 is an enclosure formed by lower body 71 and cover 72. Each of coaxial conductors 110, 120 and 130 comprises center conductor 111, dielectric ring 112 and shell 113.

Indicator assembly 150 comprises a pair of stationary contacts 153A and 153B, a movable contact cantilever 151 and a transfer pushers 152A and 152B. Movable contact cantilever 151 comprises movable contacts 151A and 151B. Stationary contacts 153A and 153B are soldered to the printed circuit board (PCB) 156. Center 151C of movable contact cantilever 151 is also soldered to PCB 156. Each of the transfer pushers 152A and 152B is placed in a central hole of soft magnetic core 11 and goes through an opening in PCB 156.

As shown in FIG. 1, when rocker 31 is attracted by left-hand core 11 of solenoid 10 and turns clockwise, the right end of rocker cantilever 32 pushes pusher assembly 50 downward and causes conductor reed 53 to connect conductor the center conductor 111 of both coaxial conductors 110 and 120, enabling RF signals to pass from coaxial conductor 110 to coaxial conductor 120 (or vice versa). At the same time, left hand pusher assembly 60 is pushed upward by restoring spring 52 and lifts left hand conductor reed 53, disconnecting the RF signal path between coaxial conductors 110 and 130. Corresponding to this state, transfer pusher 152A is pushed upward by the left end of rocker 31 and in turn pushes the left side of movable contact 151 upward, causing left movable contact 151A to separate from stationary contact 153A and resulting in an open (disconnected) state between center 151C and stationary contact 153A, corresponding to the RF signal open state between the coaxial conductors 110 and 130. Also at this time, the right end of movable conductor 151 is not affected by transfer pusher 1528 and restores to its natural position of connecting movable contact 151B and stationary contact 153B and resulting in an closed (connected) state between center 151C and stationary contact 153B, corresponding to the RF signal closed state between the coaxial conductors 110 and 120.

As aforementioned, a drawback in such a design is that proper contact pressure is necessary between the movable contacts and stationary contacts to make it reliable, which increases the complexity in the tuning and adjustment process in making the switch. Another drawback is that it is difficult to form a sealed enclosure to protect the movable and stationary contacts because of the necessary linking mechanisms between the movable contacts and the switch actuation, rendering the movable and stationary contacts to be susceptible to contamination and failures. This invention discloses a new coaxial RF switch optoelectronic indicator means which greatly improves the reliability and reduces manufacturing complexity, as detailed as follows.

Figure 2:
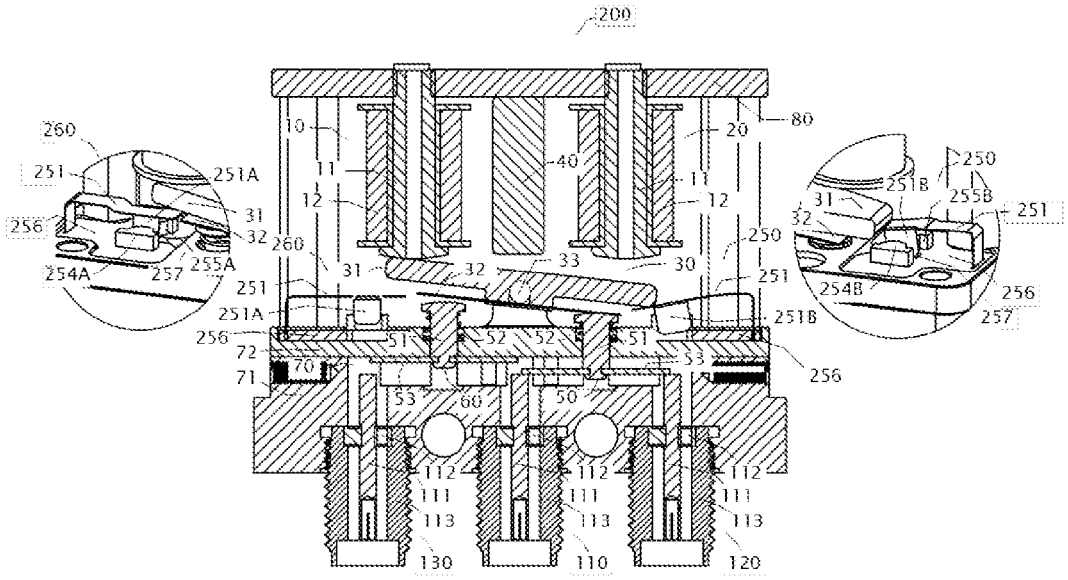
FIG. 2 is a cross-sectional view and detailed view of an exemplary embodiment of an improved coaxial RF switch optoelectronic indicator of the present invention.

FIG. 2 shows a cross-sectional view of an exemplary embodiment of an improved coaxial RF switch optoelectronic indicator. With reference to FIG. 2, an improved coaxial RF switch 200 suitably comprises a pair of solenoids 10 and 20, rocker assembly 30, permanent magnet 40, soft magnetic plate 80, pusher assemblies 50 and 60, cavity 70, coaxial connectors 110, 120, and 130, and optoelectronic indicator assemblies 250 and 260.

Rocker assembly 30 comprises soft magnetic rocker 31, rocker cantilever 32 and pivot 33.

Pusher assemblies 50 and 60 comprises pusher 51, restoring spring 52 and conductor reed 53. Pusher 51 can be made of any dielectric material. Spring 52 can be made of stainless steel. One function of spring 52 is to push pusher 51 upward to its natural position when external force is not applied. Conductor reed 53 can be made of any conducting material such as BeCu and are preferably plated with Gold. Conductor reed 53 is affixed to pusher 51 on the bottom so that conductor reed 53 moves with pusher 51.

Each of coaxial conductors 110, 120 and 130 comprises center conductor 111, dielectric ring 112 and shell 113.

Left-hand optoelectronic indicator assembly 260 comprises light emitting diode (LED) 254A, photo-sensor 255A and a photo-shutter assembly 251 which includes a folded shutter 251A. Right-hand optoelectronic indicator assembly 250 comprises light emitting diode (LED) 254B, photo-sensor 255B and a photo-shutter assembly 251 which includes a folded shutter 251B. LED 254A and 254B can be any light emitting diodes which emit visible or infrared light. Photo-sensor 255A (e.g., a photo diode or a photo transistor) is sensitive to the light emitted by LED 254A, and photo-sensor 255B (e.g., a photo diode or a photo transistor) is sensitive to the light emitted by LED 254B. A key feature of photo-sensors 254A and 254B is that they are in a conductive state when they receive light from their corresponding LEDs and otherwise they are in a non-conductive state. Photo-sensor 254A and 254B can also be other light sensitive elements which changes electrical conductivity with light. In this exemplary embodiment, LED 254A and 254B are surface-mount side-emitting LEDs, and photo-sensor 255A and 255B are surface-mount side-receiving photo-sensors. Left-hand photo-shutter 260 comprises a cantilever 251 with a folded shutter 251A. Right-hand photo-shutter 250 comprises a cantilever 251 with a folded shutter 251B. LED 254 (A and B), photo-sensors 255 (A and B) and photo-shutter assembly 251 are soldered to a printed circuit board (PCB) 256. Cantilever 251 can be made from a flexible metal sheet and is placed below rocker 31, wherein folded shutter 251A or 251B can move up or down when cantilever 251 bends. As shown in FIG. 2, when cantilever 251 in the right-hand optoelectronic indicator 250 is pushed downward by rocker 31, folded shutter 251B moves downward and blocks the optical path between LED 254B and 255B, causing photo-sensor 255B to be in a non-conductive state. At the same time, cantilever 251 in the left-hand optoelectronic indicator 260 is not affected by rocker 31 and restores to its natural upward state, folded shutter 251A stays up and un-blocks the optical path between LED 254B and 255B, causing photo-sensor 255A to be in a conductive state.

PCB 256 comprises a cut slot 257 between LED 254A (or 254B) and photo-sensor 255A (or 255B), allowing folded shutter 251A (or 251B) to move into said slot 257 so that the movement of 251A (or 251B) is not prohibited or hindered. Also, it allows folded shutter 251A (or 251B) to block the optical path more completely.

As shown in a coaxial RF switch 200 in FIG. 2, when rocker 31 is attracted by left-hand core 11 of solenoid 10 and turns clockwise, the right end of rocker cantilever 32 pushes pusher assembly 50 downward and causes conductor reed 53 to connect the center conductors 111 of both coaxial conductors 110 and 120, enabling RF signals to pass from coaxial conductor 110 to coaxial conductor 120 (or vice versa) (closed state). Corresponding to this closed state, left-hand cantilever 251 and its folded shutter 251A lift up and allow photo-sensor 255A to receive light emitted from LED 254A, causing photo-sensor 255A to be in a conductive state, in correspondence to the closed state of the RF channel between coaxial conductors 110 and 120. At the same time, left hand pusher assembly 60 is pushed upward by restoring spring 52 and lifts left hand conductor reed 53, disconnecting the RF signal path between coaxial conductors 110 and 130 (open state). Corresponding to this open state, the right end of rocker 31 moves downward and pushes right-hand cantilever 251 down, causing folded shutter 251B to move downward and block the optical path between LED 254B and photo-sensor 255B, rendering photo-sensor 255B in a non-conductive state, in correspondence to open state of the RF channel between coaxial conductors 110 and 130.

Oppositely, when rocker 31 is attracted by right-hand core 11 of solenoid 20 and turns counter-clockwise, the corresponding pusher assembly moves in the directions opposite to aforementioned which causes the RF channel between 110 and 120 to be open and the RF channel between 110 and 130 to be closed. Correspondingly, the relative movements of the left- and right-ends of rocker 31 cause folded shutter 251B to lift up and folded shutter 251A to move down, rendering photo-sensor 255A in a non-conductive state and photo-sensor 255B in a conductive state, achieving the RF channel indication functions.

Similarly, shutter cantilever 251 or portion of it can be placed above rocker 31 and interacts with rocker 31 to cause folded shutter 251A and 251B to move up or down, causing photo-sensors 255A and 255B to be non-conductive or conductive, achieving the corresponding RF channel indication functions, herein details to be omitted.

Figure 3:
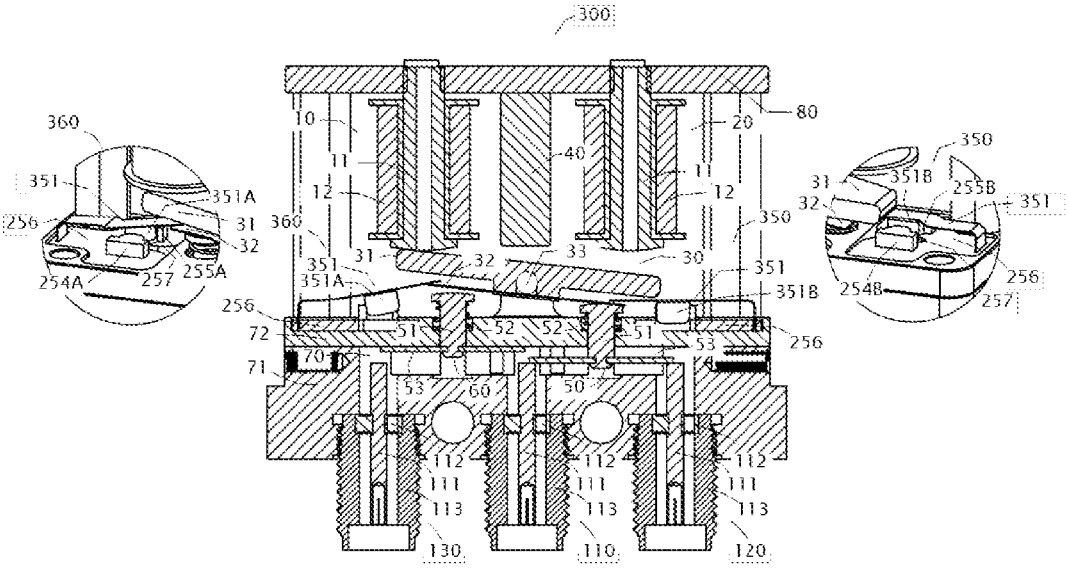
FIG. 3 is another cross-sectional view and detailed view of an exemplary embodiment of an improved coaxial RF switch optoelectronic indicator of the present invention.

FIG. 3 shows a cross-sectional view of an exemplary embodiment of an improved coaxial RF switch optoelectronic indicator. With reference to FIG. 3, an improved coaxial RF switch 300 suitably comprises a pair of solenoids 10 and 20, rocker assembly 30, permanent magnet 40, soft magnetic plate 80, pusher assemblies 50 and 60, cavity 70, coaxial connectors 110, 120, and 130, and optoelectronic indicator assemblies 350 and 360.

As shown in FIG. 3, left-hand optoelectronic indicator assembly 360 comprises light emitting diode (LED) 254A, photo-sensor 255A and a photo-shutter assembly 351 which includes a folded shutter 351A. Right-hand optoelectronic indicator assembly 350 comprises light emitting diode (LED) 254B, photo-sensor 255B and a photo-shutter assembly 351 which includes a folded shutter 351B. Left-hand photo-shutter 360 comprises a cantilever 351 with a folded shutter 351A. Right-hand photo-shutter 350 comprises a cantilever 351 with a folded shutter 351B. One end of cantilever 351 is soldered to PCB 256. Cantilever 351 can be made from a flexible metal sheet. The other end of cantilever 351 is arranged so that it lies in between rocker 31 and rocker cantilever 32. Folded shutter 351A or 351B can move up or down when cantilever 351 bends. As shown in FIG. 3, when cantilever 351 in the right-hand optoelectronic indicator 350 is not affected externally or is pushed downward by rocker 31, folded shutter 351B is in a downward state wherein shutter 351B blocks the optical path between LED 254B and 255B, causing photo-sensor 255B to be in a non-conductive state. At the same time, cantilever 351 in the left-hand optoelectronic indicator 360 is pushed upward by rocker cantilever 32 and folded shutter 351A lifts up and un-blocks the optical path between LED 254B and 255B, causing photo-sensor 255A to be in a conductive state.

As shown in a coaxial RF switch 300 in FIG. 3, when rocker 31 is attracted by the left-hand core 11 of solenoid 10 and turns clockwise, the right end of rocker cantilever 32 pushes pusher assembly 50 downward and causes conductor reed 53 to connect conductor the center conductor 111 of both coaxial conductors 110 and 120, enabling RF signals to pass from coaxial conductor 110 to coaxial conductor 120 (or vice versa) (closed state). Corresponding to this closed state, left-hand cantilever 351 is pushed upward by rocker cantilever 32 and folded shutter 351A lifts up and allows phot-sensor 255A to receive light emitted from LED 254A, causing photo-sensor 255A to be in a conductive state, in correspondence to the closed state of the RF channel between coaxial conductors 110 and 120. At the same time, left hand pusher assembly 60 is pushed upward by restoring spring 52 and lifts left hand conductor reed 53, disconnecting the RF signal path between coaxial conductors 110 and 130 (open state). Corresponding to this open state, the right end of rocker cantilever 32 moves downward and separates from right-hand cantilever 351, causing folded shutter 351B to move downward and block the optical path between LED 254B and photo-sensor 255B, rendering photo-sensor 255B in a non-conductive state, in correspondence to open state of the RF channel between coaxial conductors 110 and 130.

Oppositely, when rocker 31 is attracted by the right-hand core 11 of solenoid 20 and turns counter-clockwise, the corresponding pusher assembly moves in the directions opposite to aforementioned which causes the RF channel between 110 and 120 to be open and the RF channel between 110 and 130 to be closed. Correspondingly, the relative movements of the left- and right-ends of rocker 31 and rocker cantilever 32 cause folded shutter 351B to lift up and folded shutter 351A to move down, rendering photo-sensor 255A in a non-conductive state and photo-sensor 255B in a conductive state, achieving the RF channel indication functions.

Figure 4:
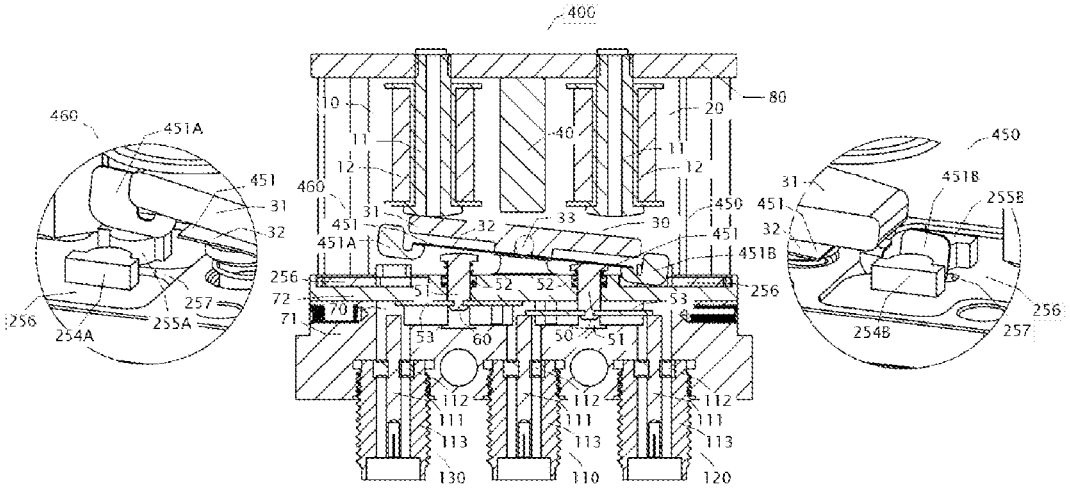
FIG. 4 is another cross-sectional view and detailed view of an exemplary embodiment of an improved coaxial RF switch optoelectronic indicator of the present invention.

FIG. 4 shows a cross-sectional view of another exemplary embodiment of an improved coaxial RF switch optoelectronic indicator. With reference to FIG. 4, an improved coaxial RF switch 400 suitably comprises a pair of solenoids 10 and 20, rocker assembly 30, permanent magnet 40, soft magnetic plate 80, pusher assemblies 50 and 60, cavity 70, coaxial connectors 110, 120, and 130, and optoelectronic indicator assemblies 450 and 460.

As shown in FIG. 4, left-hand optoelectronic indicator assembly 460 comprises light emitting diode (LED) 254A, photo-sensor 255A and a photo-shutter assembly 451 which includes a folded shutter 451A. Right-hand optoelectronic indicator assembly 450 comprises light emitting diode (LED) 254B, photo-sensor 255B and a photo-shutter assembly 451 which includes a folded shutter 451B. Left-hand photo-shutter 460 comprises a cantilever 451 with a folded shutter 451A. Right-hand photo-shutter 450 comprises a cantilever 451 with a folded shutter 451B. In this exemplary embodiment, photo-shutters 450 and 460 can be formed with the same sheet of elastic metal as rocker cantilever 32, or otherwise can be formed with a separate sheet of opaque material placed underneath rocker 31 and moves with rocker 31. Folded shutter 451A or 451B can move up or down with rocker 31. As shown in FIG. 4, when cantilever 451 in the right-hand optoelectronic indicator 450 moves downward with the right end of rocker 31, folded shutter 451B is in a downward state wherein shutter 451B blocks the optical path between LED 254B and 255B, causing photo-sensor 255B to be in a non-conductive state. At the same time, cantilever 451 in the left-hand optoelectronic indicator 460 moves upward with the left end of rocker 31 and folded shutter 451A lifts up and un-blocks the optical path between LED 254B and 255B, causing photo-sensor 255A to be in a conductive state.

As shown in a coaxial RF switch 400 in FIG. 4, when rocker 31 is attracted by the left-hand core 11 of solenoid 10 and turns clockwise, the right end of rocker cantilever 32 pushes pusher assembly 50 downward and causes conductor reed 53 to connect conductor the center conductor 111 of both coaxial conductors 110 and 120, enabling RF signals to pass from coaxial conductor 110 to coaxial conductor 120 (or vice versa) (closed state). Corresponding to this closed state, left-hand cantilever 451 moves upward with the left end of rocker 31 and folded shutter 451A lifts up and allows photo-sensor 255A to receive light emitted from LED 254A, causing photo-sensor 255A to be in a conductive state, in correspondence to the closed state of the RF channel between coaxial conductors 110 and 120. At the same time, left hand pusher assembly 60 is pushed upward by restoring spring 52 and lifts left hand conductor reed 53, disconnecting the RF signal path between coaxial conductors 110 and 130 (open state). Corresponding to this open state, the right-hand cantilever 451 moves downward with the right end of rocker 31 and folded shutter 451B moves downward and blocks the optical path between LED 254B and photo-sensor 255B, rendering photo-sensor 255B in a non-conductive state, in correspondence to open state of the RF channel between coaxial conductors 110 and 130.

Oppositely, when rocker 31 is attracted by the right-hand core 11 of solenoid 20 and turns counter-clockwise, the corresponding pusher assembly moves in the directions opposite to aforementioned which causes the RF channel between 110 and 120 to be open and the RF channel between 110 and 130 to be closed. Correspondingly, the relative movements of the left- and right-ends of cantilever 451 with rocker 31 cause folded shutter 451B to lift up and folded shutter 451A to move down, rendering photo-sensor 255A in a non-conductive state and photo-sensor 255B in a conductive state, achieving the RF channel indication functions.

Figure 5:
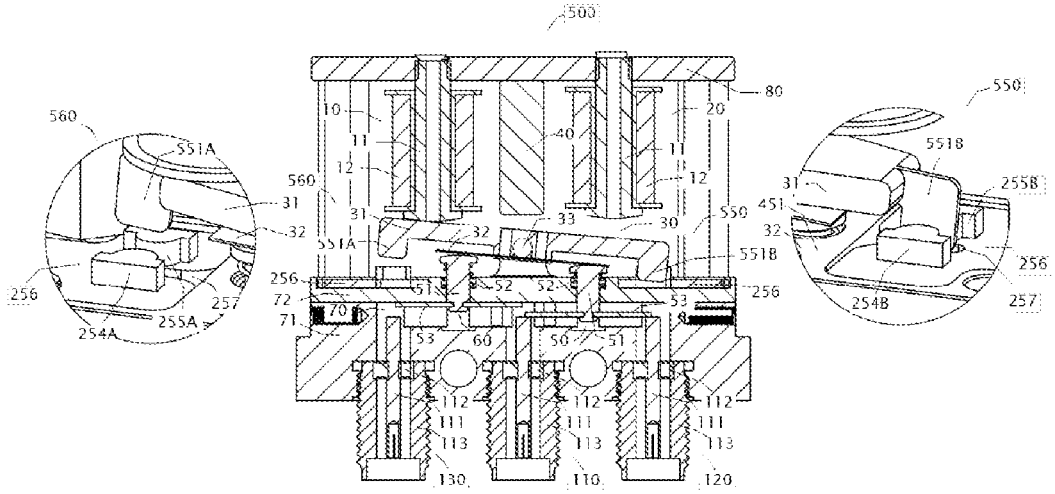
FIG. 5 is another cross-sectional view and detailed view of an exemplary embodiment of an improved coaxial RF switch optoelectronic indicator of the present invention.

FIG. 5 shows a cross-sectional view of another exemplary embodiment of an improved coaxial RF switch optoelectronic indicator. With reference to FIG. 5, an improved coaxial RF switch 500 suitably comprises a comprises a pair of solenoids 10 and 20, rocker assembly 30, permanent magnet 40, soft magnetic plate 80, pusher assemblies 50 and 60, cavity 70, coaxial connectors 110, 120, and 130, and optoelectronic indicator assemblies 550 and 560.

As shown in FIG. 5, left-hand optoelectronic indicator assembly 560 comprises light emitting diode (LED) 254A, photo-sensor 255A and a shutter 551A. Right-hand optoelectronic indicator assembly 550 comprises light emitting diode (LED) 254B, photo-sensor 255B and a shutter 551B. In this exemplary embodiment, shutters 551A and 551B are parts of rocker 31 formed at the left and right ends of rocker 31 respectively. Shutter 551A or 551B can move up or down with rocker 31. As shown in FIG. 5, when shutter 551B in the right-hand optoelectronic indicator 550 moves downward with the right end of rocker 31, shutter 551B is in a downward state wherein shutter 551B blocks the optical path between LED 254B and 255B, causing photo-sensor 255B to be in a non-conductive state. At the same time, shutter 451A in the left-hand optoelectronic indicator 560 moves upward with the left end of rocker 31 and un-blocks the optical path between LED 254B and 255B, causing photo-sensor 255A to be in a conductive state.

As shown in a coaxial RF switch 500 in FIG. 5, when rocker 31 is attracted by the left-hand core 11 of solenoid 10 and turns clockwise, the right end of rocker cantilever 32 pushes pusher assembly 50 downward and causes conductor reed 53 to connect conductor the center conductor 111 of both coaxial conductors 110 and 120, enabling RF signals to pass from coaxial conductor 110 to coaxial conductor 120 (or vice versa) (closed state). Corresponding to this closed state, left-hand shutter 551A moves upward with the left end of rocker 31 and allows photo-sensor 255A to receive light emitted from LED 254A, causing photo-sensor 255A to be in a conductive state, in correspondence to the closed state of the RF channel between coaxial conductors 110 and 120. At the same time, left hand pusher assembly 60 is pushed upward by restoring spring 52 and lifts left hand conductor reed 53, disconnecting the RF signal path between coaxial conductors 110 and 130 (open state). Corresponding to this open state, the right-hand shutter 551B moves downward with the right end of rocker 31 and blocks the optical path between LED 254B and photo-sensor 255B, rendering photo-sensor 255B in a non-conductive state, in correspondence to open state of the RF channel between coaxial conductors 110 and 130.

Oppositely, when rocker 31 is attracted by the right-hand core 11 of solenoid 20 and turns counter-clockwise, the corresponding pusher assembly moves in the directions opposite to aforementioned which causes the RF channel between 110 and 120 to be open and the RF channel between 110 and 130 to be closed. Correspondingly, the relative movements of the left- and right-hand shutters 551A and 551B with rocker 31 cause shutter 551B to lift up and shutter 551A to move down, rendering photo-sensor 255A in a non-conductive state and photo-sensor 255B in a conductive state, achieving the RF channel indication functions.

It is understood that a variety of methods can be used to fabricate the coaxial RF switch indicator. The detailed descriptions of various possible fabrication methods are omitted here for brevity.

It will be understood that many other embodiments and combinations of different choices of materials and arrangements could be formulated without departing from the scope of the invention. Similarly, various topographies and geometries of the electromechanical relay could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

What is claimed is:

1. A coaxial RF switch with an optoelectronic indicator comprising:

an RF conduction channel having a disconnected (open) state and a connected (closed) state;

a soft magnetic rocker assembly;

an optoelectronic indicator having a light emitting diode, a photo-sensor, and a shutter assembly, wherein said shutter assembly is mounted on a printed circuit board and interacts with said soft magnetic rocker assembly and causes the optical path between said light emitting diode and said photo-sensor to open (pass through) or closed (shut-off), corresponding to said connected or disconnected states of said RF channel, providing an indicator means to the switch.

2. A coaxial RF switch with an optoelectronic indicator according to claim [1] wherein said light emitting diode emits visible light and said photo-sensor is sensitive to visible light.

3. A coaxial RF switch with an optoelectronic indicator according to claim [1] wherein said light emitting diode emits infrared light and said photo-sensor is sensitive to infrared light.

4. A coaxial RF switch with an optoelectronic indicator according to claim [1] wherein said light emitting diode is of surface-mount side-emitting type and said photo-sensor is of surface-mount side-receiving type.

5. A coaxial RF switch with an optoelectronic indicator according to claim [1] wherein said shutter assembly comprises a folded shutter, wherein said folded shutter can move up and down in a slot between said light emitting diode and said photo-sensor, causing the optical path between said light emitting diode and said photo-sensor to open and close.

6. A coaxial RF switch with an optoelectronic indicator according to claim [5] wherein said printed circuit board comprising a cut-out slot between said light emitting diode and said photo-sensor to provide clearance for said folded shutter to partially move into said cut-out slot, in order not to hinder movement of said folded shutter and to more completely block said optical path in the closed state.

7. A coaxial RF switch with an optoelectronic indicator according to claim [5] wherein said soft magnetic rocker assembly comprises a soft magnetic rocker and a rocker cantilever, wherein said shutter cantilever is placed underneath said soft magnetic rocker, wherein when said soft magnetic rocker rotates, one end of said soft magnetic rocker moves downward and pushes said shutter cantilever and causes said folded shutter to move downward; wherein said folded shutter can move up or down in the space between said light emitting diode and said photo-sensor, causing the optical path between said light emitting diode and said photo-sensor to open and close.

8. A coaxial RF switch with an optoelectronic indicator according to claim [5] wherein said soft magnetic rocker assembly comprises a soft magnetic rocker and a rocker cantilever, wherein said shutter cantilever is placed above said rocker cantilever, wherein when said rocker cantilever rotates with said soft magnetic rocker, one end of said rocker cantilever moves upward and lifts said shutter cantilever up and causes said folded shutter to move upward; wherein said folded shutter can move up or down in the space between said light emitting diode and said photo-sensor, causing the optical path between said light emitting diode and said photo-sensor to open and close.

9. A coaxial RF switch with an optoelectronic indicator comprising:

an RF conduction channel having an open state and a closed state;

a soft magnetic rocker assembly comprising a soft magnetic rocker, a rocker cantilever, and a shutter; wherein when said soft magnetic rocker rotates, said shutter can move up or down in a space between said light emitting diode and said photo-sensor, causing the optical path between said light emitting diode and said photo-sensor to open or close, hence providing a means to indicate the states (connected or disconnected) of said RF channel.

10. A coaxial RF switch with an optoelectronic indicator according to claim [9] wherein said shutter is formed by folding one end of said rocker cantilever.

11. A coaxial RF switch with an optoelectronic indicator according to claim [9] wherein said shutter is formed at one end of said magnetic rocker.

* * * * *